US005490826A

United States Patent [19]

Rose

[11] Patent Number: 5,490,826

[45] Date of Patent: Feb. 13, 1996

[54] LEGWORK STRENGTHENING AND TRAINING DEVICE

[76] Inventor: Leighton K. Rose, 3482 W. 82nd St., Inglewood, Calif. 90305

[21] Appl. No.: 315,944

[22] Filed: Sep. 30, 1994

[51] Int. Cl.[6] ..... A63B 21/02

[52] U.S. Cl. ..... 482/74; 482/124

[58] Field of Search ..... 482/121, 122, 482/124, 74

[56] References Cited

U.S. PATENT DOCUMENTS

| | | | |
|---|---|---|---|
| 4,815,731 | 3/1989 | Suarez et al. | 482/124 |
| 4,830,366 | 5/1989 | Roden | 482/124 |
| 4,909,506 | 3/1990 | Smith | 482/124 |
| 5,129,647 | 7/1992 | Castellanos | 482/124 |
| 5,209,482 | 5/1993 | Hopfer | 482/124 |

*Primary Examiner*—Lynne A. Reichard
*Attorney, Agent, or Firm*—Daniel R. Kimbell

[57] ABSTRACT

A legwork strengthening and style training device. The device has a pair of leg straps for engaging around a person's thighs just above the knees. Each leg strap is a relatively wide, elongate, and elastic strap with detachable hook and lace material affixed thereto to provide size fitting adjustability. Each leg strap has an elongate sliding strap with two ends and an intermediate region, each end being attached to the leg strap, with the intermediate region being unattached to the leg strap. A pair of sliding snap hooks are provided, each having a sliding portion which has an aperture through which the intermediate region of the sliding strap slidably passes and an upper hook end which is detachably attachable to the attachment ends of the elastic resistance member. The upper hook end is rotatably connected to the sliding portion. The device has an elastic resistance member with an elongate elastic central body with a length of latex tubing with attachment ends fitted into terminal ends of the latex tubing with a clamp mechanism provided to retain the attachment ends within the latex tubing. The attachment ends have apertures formed therein for hooking with the hook ends of the sliding snap hooks.

7 Claims, 3 Drawing Sheets

LEGWORK STRENGTHENING AND TRAINING DEVICE

BACKGROUND OF THE INVENTION

1. Field of the Invention

This invention relates to the field of exercise and athletic training devices, and more particularly to a device for strengthening a person's legs and self training of his or her stride for events such as sprinting, soccer, basketball, baseball, football, aerobic dancing, and other activities.

2. Description of the Prior Art

Since before the time of the ancient Greeks, athletes have dreamed of running faster, jumping higher and longer, and improving their performance in every respect. Until relatively recently, the four minute running mile was considered a physical barrier, but now even many high school runners can achieve a four minute mile. Even though performance records continue to be broken, pushing the standards ever higher, athletes nonetheless continue to meet and surpass these increasing performance levels. The development of improved equipment and scientific training device and methods have largely been responsible for these improvement.

For many athletic activities, such as sprinting and middle distance running, basketball, football, baseball, soccer, to name just a few, leg strength, stomach strength, and speed development is crucial to high performance. For many of these activities, especially sprinting, athletes need to have not only great leg strength, but also have quick leg acceleration and opening up speed, high turnover, high knee lift, all while keeping the knees from splaying out. While traditional weight training is useful for increasing leg strength, there remains a need a device which attends to the other needs. For others, such as aerobic dancers and stepping exercises, who desires to burn fat and achieve a better body contour, achieving muscle tone and fat burning in the hips, thighs and buttocks is a major goal. The more concentrated the workout and exercise, the shorter the workout time can be. There accordingly remains a device which can achieve all these goals.

SUMMARY OF THE INVENTION

The invention provides a legwork strengthening and style training device comprising:

a pair of leg straps for engaging around a person's thighs just above the knees, each leg strap having an elongate sliding strap means with two ends and an intermediate region, each end being attached to the leg strap, with the intermediate region being unattached to the leg strap;

a pair of sliding snap hooks, each having one end which is slidably retained on the intermediate region of the elongate sliding strap, and another end with a hook means; and an elastic resistance member having an elongate elastic central body with attachment ends located at terminal ends of the elastic central body, wherein the leg straps are wrapped around the wearer's thighs just above the knees and the attachment ends of the elastic resistance member are hooked onto the hook means of the sliding snap hooks.

The invention further provides a legwork strengthening and style training device comprising:

a pair of leg straps for engaging around a person's thighs just above the knees, each leg strap comprising relatively wide, elongate, and elastic straps with detachable hook and lace material affixed thereto to provide size fitting adjustability for a variety of wearers, each leg strap having an elongate sliding strap means with two ends and an intermediate region, each end being attached to the leg strap, with the intermediate region being unattached to the leg strap;

a pair of sliding snap hooks, each comprising a sliding portion which has an aperture through which the intermediate region of the sliding strap slidably passes, and an upper hook end which is detachably attachable to the attachment ends of the elastic resistance member, the upper hook end being rotatably connected to the sliding portion; and an elastic resistance member having an elongate elastic central body comprising a length of latex tubing with attachment ends fitted into terminal ends of the latex tubing, with clamp means provided to retain the attachment means with the latex tubing, said attachment ends having apertures formed therein, wherein the leg straps are wrapped around the wearer's thighs just above the knees with the sliding straps facing medially between the wearer's legs, and the attachment ends of the elastic resistance member are hooked onto the hook means of the sliding snap hooks.

DESCRIPTION OF THE PREFERRED EMBODIMENT

Figure 1:
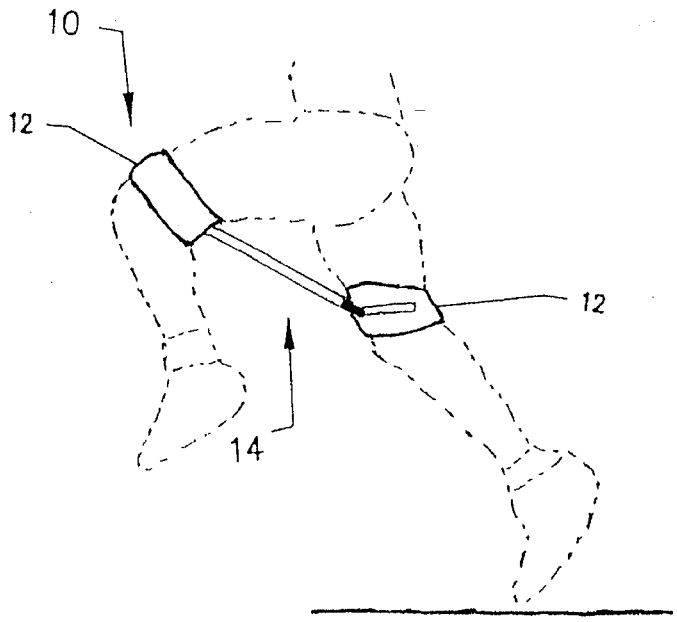
FIG. 1 is a partial perspective view of a runner's legs who is using the legwork strengthening and style training device of the invention.

Referring first to FIG. 1, the lower body of a person is shown running while wearing the legwork strengthening and style training device 10 of the invention. The device has two leg straps 12 which wrap around a user's thighs just above the knees, and an elastic resistance member 14 which attaches to the leg straps 12. As a person runs and moves his or her legs, the elastic resistance member 14 will provide dynamic resistance as the person lifts his leg and will return the feet to the ground more quickly. This action increases the strength of the thighs and stomach, increases the leg acceleration and opening up speed, turnover speed, degree of knee lift, and stride length, all while keeping the knees from splaying out. The result is better strength and style.

Figure 2:
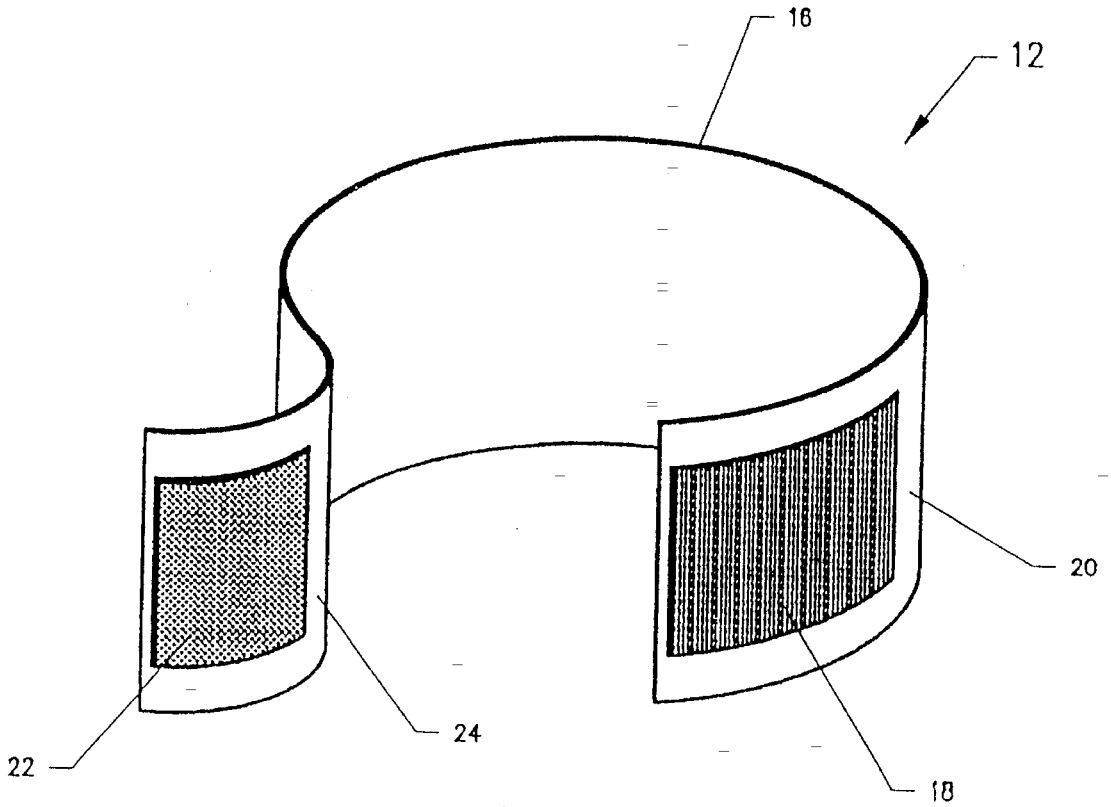
FIG. 2 is a front perspective view of a leg strap of the invention.

Referring to FIG. 2, the leg straps 12 comprise a relatively wide and long panel of material 16, such as NYLON® and with SPANDEX® to provide some longitudinal "give"

around the wearer's thighs when they are wrapped therearound, just above the user's knees. A first patch of hook and loop material 18, such as VELCRO®, is attached to the outer face 20 of one end of the panel of material 16, and second patch hook and lace material 22, which is complementary to the first patch of hook and lace material 20, is attached to the inner face 24 of the other end of the panel 16. The hook and lace material gives the leg strap 12 adjustability to a variety of wearers. For added comfort, the leg straps can have an inner liner or terry cloth and/or neoprene rubber, or other cushioning padding 25. (See FIG. 5.) The leg strap 12 is washable.

Figure 3:
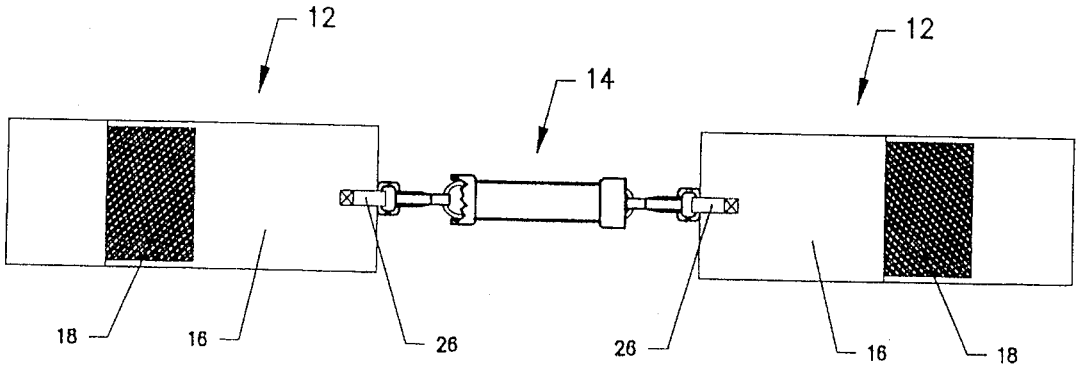
FIG. 3 is a side view of the legwork strengthening and style training device of FIG. 1.
Figure 4:
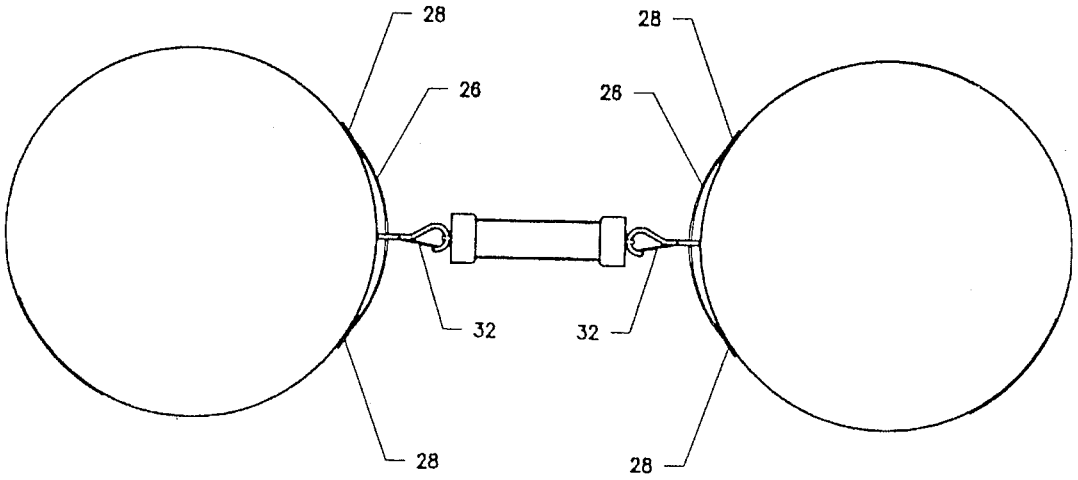
FIG. 4 is a top view through view lines 4–4 of FIG. 3 of the legwork strengthening and style training device.
Figure 5:
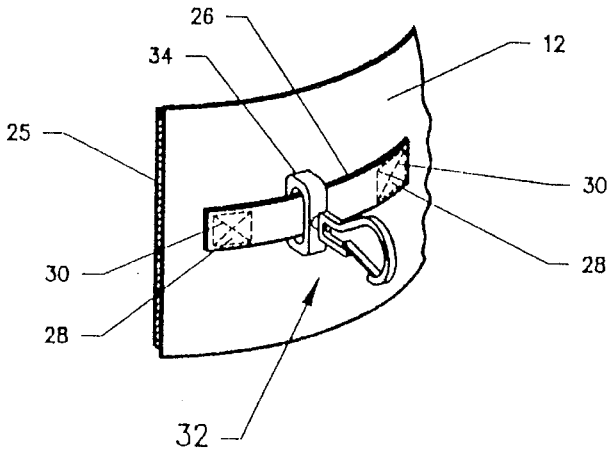
FIG. 5 is a partial perspective detail view showing the slide strap on the leg straps and the snap hook of the invention.
Figure 6:
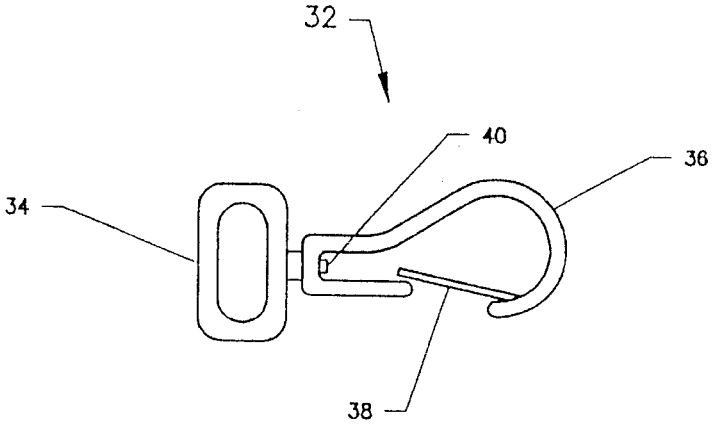
FIG. 6 is a partial perspective view showing the sliding hook of the invention.

Referring to FIGS. 3–5, the two leg straps 12 have an elongate slide strap 26 attached thereto at two ends 28, (i.e. with stitching lines 30), with the portion therebetween not being affixed to and floating on the leg straps 12. A sliding snap hook 32 is slidably positioned on each of the slide strap 26 by a sliding ring 34. The sliding snap hook 32 has a upper hook end 36, which is closeably with a spring-loaded tongue 38. By pushing up on the spring loaded tongue 38, access can be gained to the hook end 36 of the sliding snap hook 32. The upper hook end 36 is preferably rotatable on the sliding ring 34 portion, i.e. by a pivot pin 40. The sliding snap hook 32 is preferably made of strong material such as metal, although strong plastic may also be used. The leg straps 12 are worn with the sliding straps 26 facing medially inwardly between the wearer's legs. The slide straps 26 are important since in experimental versions without slide straps, where the snap hooks were rigidly attached to on point on the leg straps (not shown), the leg straps 12 tended to spin and twist on the wearer's legs when the pulling force of the resistance member 14 was applied. This was not only uncomfortable, but also detracted and interfered with effective functioning of the device 10.

Figure 7:
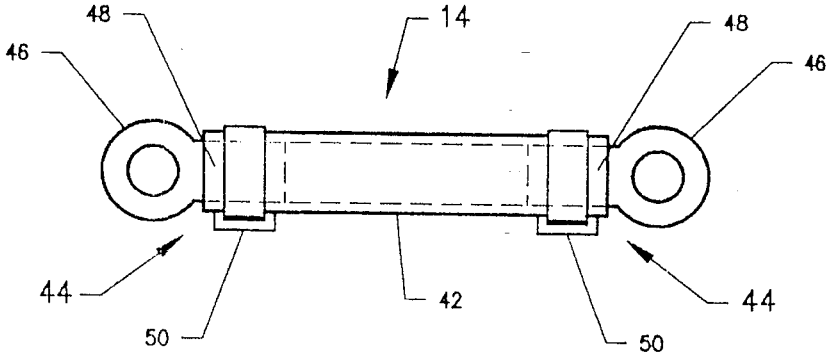
FIG. 7 is a perspective view of the elastic resistance member of the invention.

Referring to FIGS. 3, 4 and 7. the elastic resistance member 14 is shown. It has a central body 42 which provides elastic resistance. The inventor utilizes natural latex rubber tubing, although other materials, such as synthetic rubbers, plastics, or even springs could be utilized. However, natural latex tubing is lightweight, readily available, safe, and low in cost. Tie ends (attachment means) 44 are positioned on the ends of the central body 42. The tie ends 44 are ring shaped at one end 46 and are cylindrical at the other end 48. The cylindrical ends 28 are slipped into the interior of the latex tubing 42, and are permanently held in place with nylon tie straps 50 and preferably also with rubber adhesive. The ring ends 46 are hooked onto the hook ends 36 of the sliding snap hooks 32. The tie ends 44 are made of metal or strong plastic, such as Lexan® or Delrane®. The inventor presently provides the three different resistant levels of the elastic resistance member 14 by utilizing latex rubber tube of different wall thickness, i.e. 1/16", 3/32", and 1/8" thick, for low, medium and high resistance, respectively. The inventor uses tie straps 50 of different colors to positively identify the resistance level of the elastic resistance member 14. The total length of the elastic resistant member 14 can also be varied depending upon the stride length of the user.

If desired, the device can be embodied so that at least one end of the elastic resistance members 14 is directly fixable on the sliding straps, without using sliding snap hooks (not shown.) Such an embodiment would be ideal for lighter duty versions of the device, such as walking and use for aerobic dancing or exercise.

In the use of the device 10, the user will wrap the leg straps 12 around his or her legs just above the knees and hook the elastic resistance member 14 onto the sliding snap hooks 32. The user can then run, jump and otherwise exercise. The resistance provided by the resistance member 14 will provide resistance as the runner separates his or her legs at the knees. The device 10 will help the runner develop greater leg and stomach strength, and also greater leg acceleration and opening up .speed, high turnover, high knee lift, all while keeping the knees from splaying out.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A legwork strengthening and style training device comprising:

a pair of leg straps adapted for engagement around a wearer's thighs just above the wearer's knees, each leg strap having an elongate sliding strap means with two ends and an elongate intermediate region, each end being attached to the leg strap, with the intermediate region being unattached to and overlaying the leg strap;

a pair of sliding snap hooks, each having one end which is slidably retained on the intermediate region of the elongate sliding strap, and another end with a hook means; and an elastic resistance member having an elongate elastic central body with attachment ends located at terminal ends of the elastic central body, wherein the leg straps are adapted for wrapping around the wearer's thighs just above the knees and the attachment ends of the elastic resistance member are hooked onto the hook means of the sliding snap hooks, and wherein the sliding snap hooks are slideable n said elongate sliding strap around a portion of the circumference of the leg straps so that during use of the legwork strengthening and style training device, the pair of leg straps do not spin and twist on the wearer's legs.

2. The legwork strengthening and style training device of claim 1, wherein the leg straps comprise wide, elongate, and elastic straps with detachable hook and lace material affixed thereto to provide size fitting adjustability.

3. The legwork strengthening and style training device of claim 1, wherein the leg straps further have soft lining for extra comfort.

4. The legwork strengthening and style training device of claim 1, wherein the elastic resistance member comprises a length of latex tubing with the attachment ends fitted into the latex tubing with clamp means provided to retain the attachment means fixed to the latex tubing, said attachment ends having apertures formed therein.

5. The legwork strengthening and style training device of claim 1, wherein each of the sliding snap hooks comprise a sliding portion which has an aperture through which the sliding strap slidably passes, and an upper hook end which is detachably attachable to the attachment ends of the elastic resistance member, the upper hook end being rotatably connected to the sliding portion.

6. A legwork strengthening and style training device comprising:

a pair of leg straps for engaging around a wearer's thighs just above the wearer's knees, each leg strap comprising a wide, elongate, and elastic strap with detachable hook and lace material affixed thereto to provide size fitting adjustability for a variety of wearers, each leg strap having an elongate sliding strap means with two ends and an elongate intermediate region, each end being attached to the leg strap, with the intermediate region being unattached to and overlaying the leg strap;

a pair of sliding snap hooks, each comprising a sliding portion which has an aperture through which the intermediate region of the sliding strap slidably passes, and an upper hook end which is detachably attachable to the attachment ends of the elastic resistance member, the upper hook end being rotatably connected to the sliding portion; and an elastic resistance member having an elongate elastic central body comprising a length of latex tubing with attachment ends fitted into terminal ends of the latex tubing, with clamp means provided to retain the attachment means with the latex tubing, said attachment ends having apertures formed therein, wherein the leg straps are adapted for use in wrapping around the wearer's thighs just above the wearer's knees with the sliding straps facing medially between the wearer's legs, and the attachment ends of the elastic resistance member are hooked onto the hook means of the sliding snap hooks, and wherein the sliding snap hooks are slideable on said elongate sliding strap around a portion of the circumference of the leg straps so that during use of the legwork strengthening and style training device, the pair of leg straps do not spin and twist on the wearer's legs.

7. The legwork strengthening and style training device of claim 1, wherein the leg straps further have soft lining for comfort.

* * * * *